US007096761B2

(12) United States Patent
Schoor

(10) Patent No.: US 7,096,761 B2
(45) Date of Patent: Aug. 29, 2006

(54) ERGONOMIC TOOL HANDLE AND RELATED HAMMER SYSTEM

(76) Inventor: Wolfgang Schoor, 238 Villa Street, Thunder Bay, Ontario (CA) P7A 3Y2

( * ) Notice: Subject to any disclaimer, the term of this patent is extended or adjusted under 35 U.S.C. 154(b) by 60 days.

(21) Appl. No.: 10/778,025

(22) Filed: Feb. 17, 2004

(65) Prior Publication Data

US 2005/0178243 A1 Aug. 18, 2005

(51) Int. Cl.
*B25D 1/00* (2006.01)

(52) U.S. Cl. ..... 81/20; 81/21; 81/22; D8/20

(58) Field of Classification Search ..... 81/20, 81/21, 22, 23, 24; D8/20, 21, 22, 23, 24
See application file for complete search history.

(56) References Cited

U.S. PATENT DOCUMENTS 2,067,751 A * 1/1937 Beegle ..... 403/227
3,211,198 A * 10/1965 Glasgow ..... 81/19
3,874,433 A * 4/1975 Shepherd et al. ..... 81/20
4,109,339 A * 8/1978 Dietrich ..... 15/167.1
4,753,137 A * 6/1988 Kennedy ..... 81/22
5,425,176 A * 6/1995 Brainerd et al. ..... 30/308.1
5,758,552 A * 6/1998 Myers et al. ..... 81/20
D416,462 S * 11/1999 Pringle et al. ..... D8/75

FOREIGN PATENT DOCUMENTS

CA 2208951 10/2003

* cited by examiner

*Primary Examiner*—Lee D. Wilson
*Assistant Examiner*—Alvin J. Grant
(74) *Attorney, Agent, or Firm*—Ryan W. Dupuis; Michael R. Williams; Adrian D. Battison

(57) ABSTRACT

An ergonomic handle for a hand tool includes a main portion extending in a longitudinal direction between a gripping portion and a tool head supporting portion opposite the gripping portion. Both the gripping portion and the tool head supporting portion are offset at an inclination in relation to the longitudinal direction of the main portion at a compound angle including a lateral angle and a vertical angle to ensure proper alignment while improving the line of sight to the tool head. The handle is suited for a hammer system in which removable fastening means secure the tool head to the handle to permit various adjustments to be made to the tool head. A tension member is also received through the handle under tension so that the handle is pre-stressed under compression for added strength.

23 Claims, 5 Drawing Sheets

ERGONOMIC TOOL HANDLE AND RELATED HAMMER SYSTEM

FIELD OF THE INVENTION

The present invention relates to an ergonomic tool handle and more particularly relates to a hammer system including various ergonomic features.

BACKGROUND

Most hand tools are based on designs which have been around for decades or centuries and can in most cases benefit from improvements in their design made using modern ergonomic and biomechanical design and measurement techniques. Ergonomic hand tools are generally designed to minimize the effort and strain on the human body while maximizing their efficiency. Many diseases such as Carpal Tunnel Syndrome, Tendinitis, Bursitis, and Tenosynovitis can be caused by repeated use of poorly designed tools. It is known that hand tools should be designed to limit the motion of the wrist to the middle third of the range of motion to help reduce the risk of these diseases. Ergonomic hand tools having bent handles to improve the efficiency of the tool and limit the range of motion of the wrist have been known for some time. One example of which is the Bennett handle which provides a curved handle grip which angles vertically downwards into the hand and follows the line between the index finger and the ball of the thumb. This handle when employed for example on a hammer reduces the range of motion of the wrist and improves the striking angle of the hammer. The Bennett handle however does not bring the tool into alignment with the forearm. This requires that the individual using the tool angle their wrist slightly to bring the tool into alignment with the forearm during use. This can result in repetitive strain injuries if the tool is used often or for long periods of time. Most hand tools have a handle which is substantially straight. This tends to result in the tool head falling in the line of sight of the individual 5 using the tool and obscuring the work area.

Canadian Patent 2,208,951 discloses a handle design with improved ergonomics in view of the above prior handle designs, however the tool head is not suitably aligned with the offset gripping portion for all applications, accordingly, the applications of the handle to a hammer head are limited.

SUMMARY

According to one aspect of the present invention there is provided a hand tool comprising:

a tool head for performing work;

a handle including a main portion extending in a longitudinal direction between a gripping portion and a tool head supporting portion opposite the gripping portion;

the gripping portion being offset at an inclination in relation to the longitudinal direction of the main portion; and the tool head supporting portion being offset at an inclination in relation to the longitudinal direction of the main portion.

The gripping portion and the tool head supporting portion are preferably offset at a lateral angle from the main portion in a same direction and offset at a vertical angle from the main portion in opposite directions such that both the gripping portion and the tool head supporting portion are offset from the main portion of the handle at a compound angle including the lateral angle and the vertical angle.

Offsetting both the gripping portion and the tool head supporting portion ensures that the tool head is properly aligned with the gripping portion while improving the line of sight to the tool head of the person using the tool handle.

In the example of hammers, the hammer works by transferring momentum or releasing kinetic energy during impact with a nail or other objects. For typical power grip hammering operations, impact time is less then a millisecond, with peak accelerations of several thousand meters per second squared. The ergonomic handle serves as an attenuator so that the vibration and referred impact shock is not transmitted to the user's hand, and from there elsewhere to the human body, each time the hammer impacts a surface.

According to a second aspect of the present invention there is provided a hammer comprising:

an elongate handle having a main portion and an end portion of reduced dimension;

a head having a body and an opening formed in the body for snugly receiving the end portion of the handle therein; and fastening means for securing the end portion of the handle within the opening in the head whereby the head remains selectively separable from the handle.

In the event the hammerhead and hammer handle interface are designed as a fixed system, the threaded or other fastening means acts upon the hammer and handle connection as a support and stiffener rod to increase its strength substantially, so that the tool can also be used for prying or extracting object's.

The opening preferably extends through the body of the head with a wedge for being snugly received in one end of the opening and the narrow portion of the handle being received in an opposing end of the opening.

The wedge may include a through bore receiving the fastening means therethrough.

There may be provided a compression plate member spanning the end of the opening receiving the wedge therethrough with the fastening means securing the plate member to the handle for clamping the head and wedge member therebetween.

There may be provided a plurality of interchangeable wedges having differing weights.

The fastening means may comprise a threaded rod supported on the handle and a threaded nut securing the head between the nut and the handle.

The threaded rod is preferably received in a bore formed in the handle with a compressible member surrounding the rod within the bore.

The fastening means may include a first threaded member secured to the handle and a second threaded member for mating with the first threaded member. The fastening means may further include a resilient washer clamped between confronting faces of the first and second threaded members.

The handle preferably includes reinforcing hafting material surrounding the main portion adjacent the end portion supporting the head thereon.

When the body of the head extends in a longitudinal direction of the head between an impact face which is perpendicular to the longitudinal direction and a claw member which curves in the longitudinal direction towards the handle and in which the handle is supported transversely to the longitudinal direction of the head, preferably there is provided a domed fulcrum member selectively mounted on the body of the head opposite the handle. Alternatively, the domed fulcrum member may be integrally formed on the body of the head opposite the handle continuous in profile with the claw member.

The hammer may be part of a kit including a plurality of heads, each having an opening formed therein of similar configuration for receiving the end portion of the handle therein and each head varying in dimensions from remaining heads of the kit. In this instance, at least one head may include an impact area differing in dimensions from remaining heads of the kit and at least one head may include a weight which is greater than a weight of each of the remaining heads of the kit.

The main portion of the handle of the hammer may extend in a longitudinal direction of the handle between a gripping portion of the handle and the end portion supporting the head thereon opposite the gripping portion. Both the gripping portion and the end portion in this instance are preferably offset at an inclination in relation to the longitudinal direction of the main portion.

The gripping portion and the tool head supporting portion of the hammer handle are preferably offset at a lateral angle from the main portion in a same direction and offset at a vertical angle from the main portion in opposite directions such that both the gripping portion and the tool head supporting portion are offset from the main portion of the handle at a compound angle including the lateral angle and the vertical angle.

According to a further aspect of the present invention there is provided a hammer comprising:

an elongate handle having a main portion and an end portion of reduced dimension, the handle including an elongate bore extending from an open at the end portion to a terminal end within the handle;

a head having a body and an opening formed in the body for snugly receiving the end portion of the handle therein; and a tension member received through the bore in the handle and secured under tension between the terminal end of the bore and the head.

The tension member preferably comprises a rigid rod threadably secured to the terminal end of the bore at one end. When the head is secured to the handle by a clamping member, the opposing end of the tension member is preferably threadably secured to the clamping member.

When the bore extends at least one third a length of the handle, the handle is preferably maintained under compression between the terminal end of the bore and the end portion of the handle by the tension member.

BRIEF DESCRIPTION OF THE DRAWINGS

In the accompanying drawings, which illustrate exemplary embodiments of the present invention.

DETAILED DESCRIPTION

Figure 2:
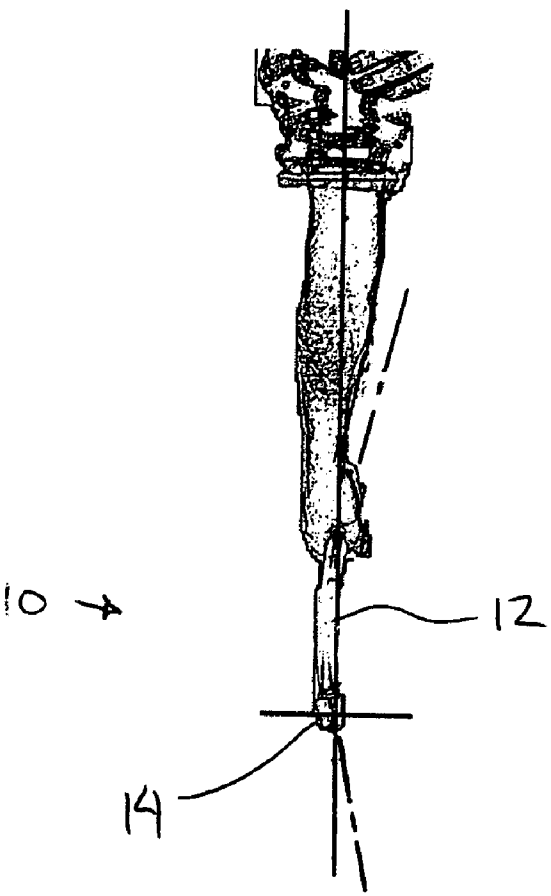
FIG. 2 is a top plan view of a tool in accordance with the present invention, shown supported in a person's hand.
Figure 1:
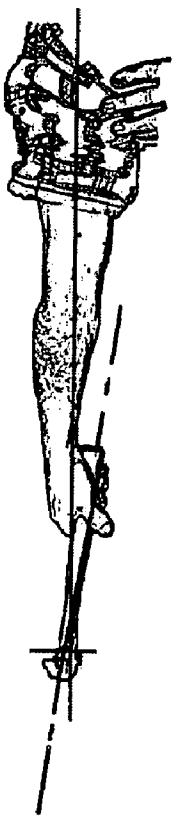
PRIOR ART FIG. 1
FIG. 1 is a top plan view of a prior art hammer supported in a person's hand.
Figure 3:
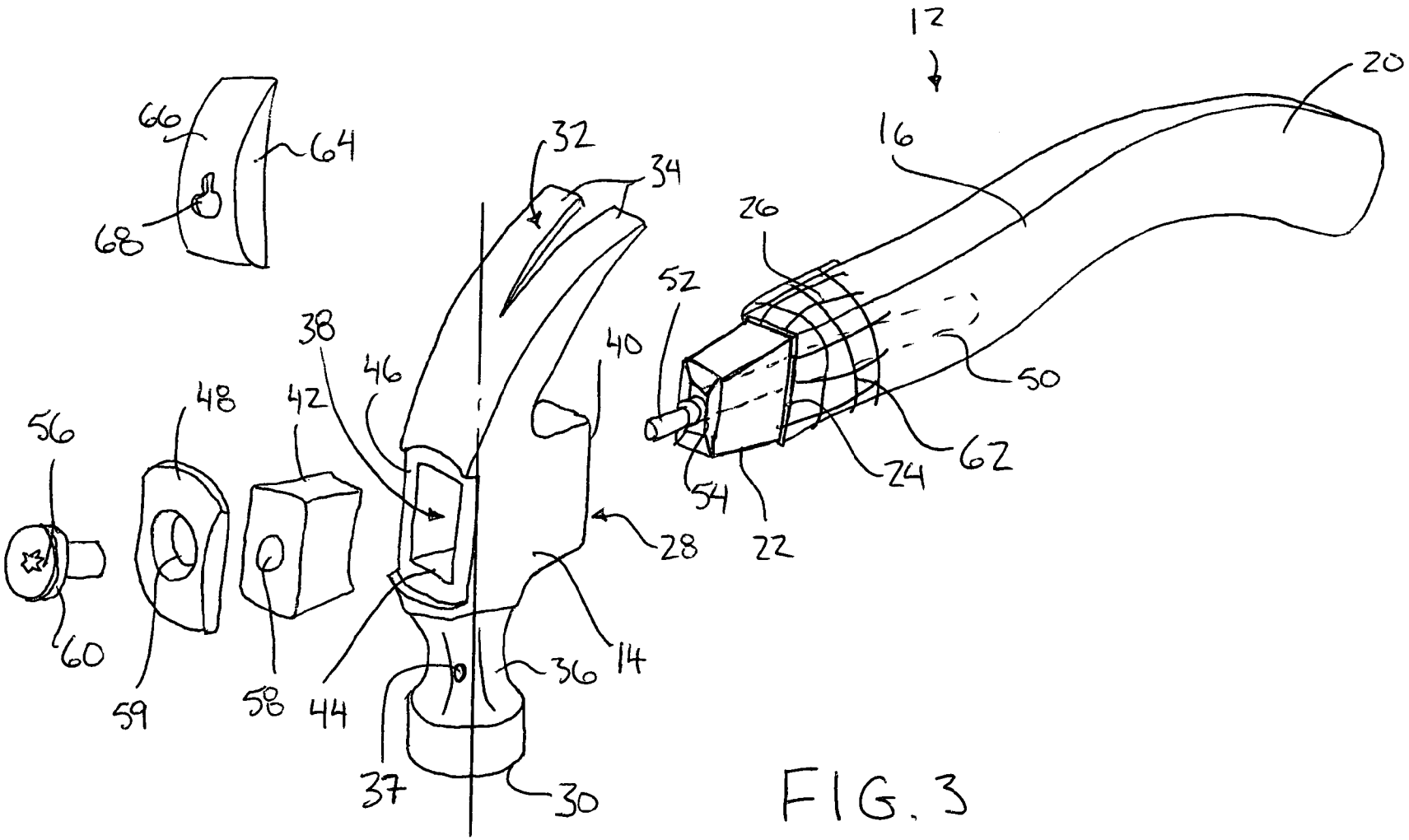
FIG. 3 is an exploded perspective view of a hammer.
Figure 5:
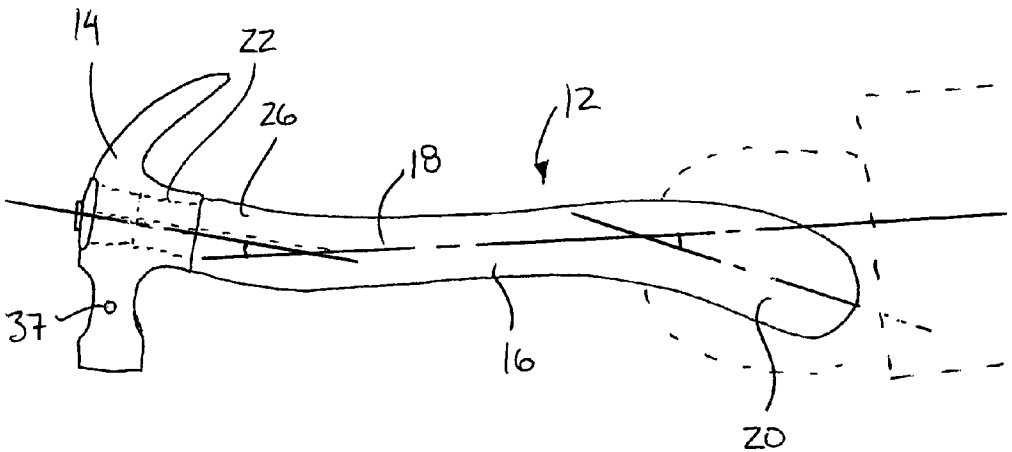
FIGS. 4 and 5 are respective top plan and side elevational views of the hammer according to FIG. 3 when supported in a person's hand.
Figure 4:
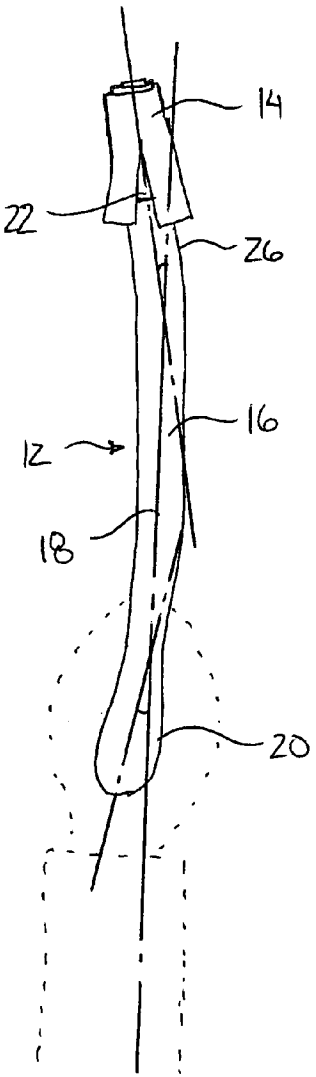
Figure 6:
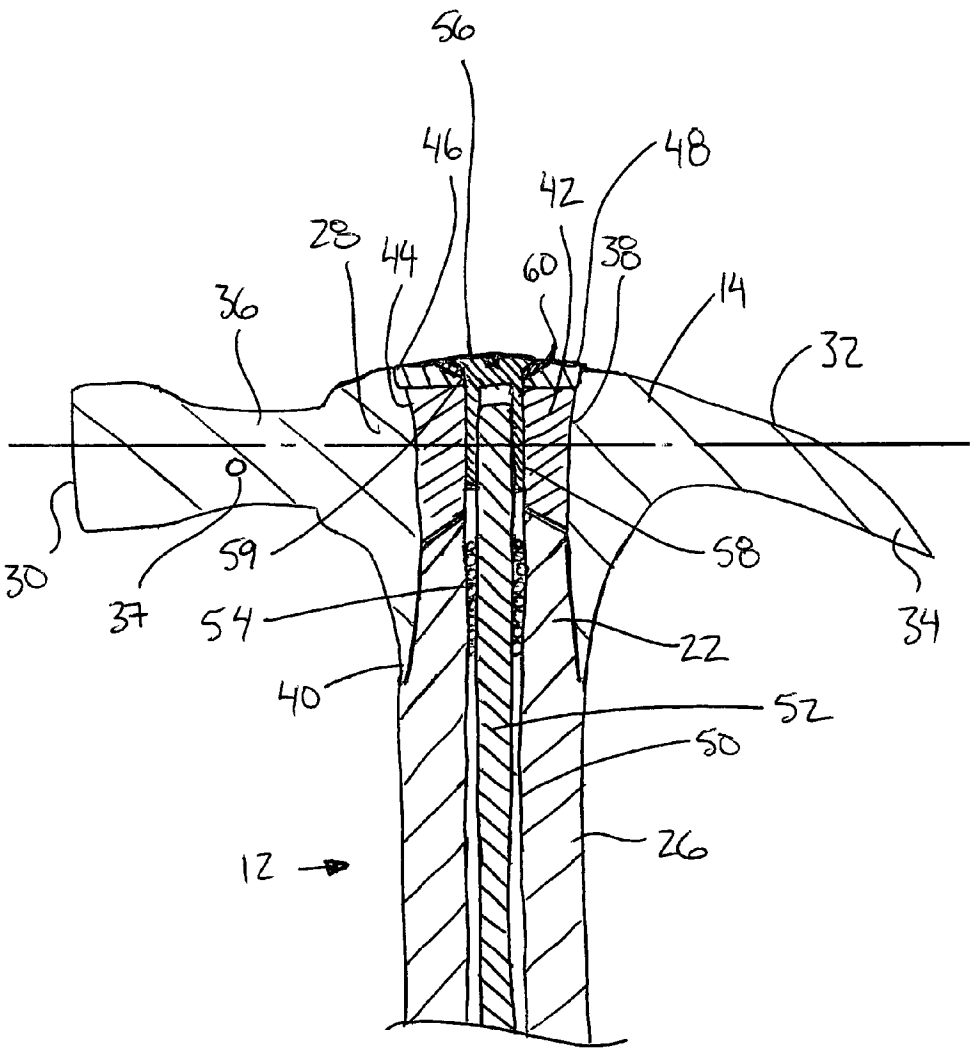
FIG. 6 is a sectional view of a hammer head supported on the ergonomic tool handle.

Referring to the accompanying drawings, there is illustrated an ergonomic hand tool generally indicated by reference numeral 10. The tool 10 includes an ergonomic handle 12 for supporting a tool head 14 thereon to perform useful work.

The handle is ergonomically shaped for gripping at an offset angle in relation to the tool head to bring the tool head into alignment with the forearm of the individual using the tool. The handle helps reduce many of the inefficiencies associated with conventional hand tool designs and helps reduce the risk of repetitive strain injuries. While a hammer is illustrated as the preferred embodiment, the tool handle is useful and can readily be applied to paint brushes and scrappers, sheering tools including scissors and the like, writing instruments such as a pen or any other hand tool in which working or sporting goods or other equipment associated with implements are supported on a handle.

The handle 12 includes a main portion 16 which extends generally straight in a longitudinal direction 18 with a smooth contoured surface. A gripping portion 20 is supported at one end of the main portion 16 to extend therefrom at a compound angle relative to the longitudinal direction of the main portion. Opposite the gripping portion 20, there is provided a narrowing, wedge shaped, end portion 22 extending from the main portion 16 which includes a portion of reduced dimension to define a shoulder 24 against which the tool head 14 abuts when mounted on the handle. The end portion 22 and a transition portion 26 of the handle which connects the end portion 22 to the main portion 16, extend at a compound angle relative to the longitudinal direction 18 of the main portion.

The compound angle of each of the gripping portion 20 and the narrow end portion 22 in relation to the main portion 16 include a lateral angle and a vertical angle. The lateral angle is defined as a deviation from a vertical plane locating a longitudinal direction of a forearm of the person supporting the hand tool in their hand and also containing the longitudinal direction 18 of the main portion. The vertical angle is defined as an angular deviation from a horizontal plane containing the longitudinal direction 18 of the main portion of the handle and the longitudinal direction of the forearm of a person gripping the handle in their hand.

The vertical angle of the gripping portion is a downward angle from the horizontal plane while the narrow end portion 22 has an opposing upward deviation such that, in side elevational view, the handle follows and S-shaped profile. The lateral angle of both the gripping portion 20 and the end portion 22 are in the same direction, comprising an interior direction which the palm of a hand of the person gripping the tool faces such that in a top plan view the handle follows a continuous arcuate profile which is concave on an interior side which the palm of the person gripping the handle faces.

In the illustrated embodiment the tool head 14 comprises a hammer head. The hammer head includes a body 28 which extends in a longitudinal direction between an impact face 30 lying perpendicular to the longitudinal direction of the body and a claw member 32 opposite the impact face. When the head is mounted on the tool handle, transversely to the handle with a longitudinal direction of the head lying generally perpendicular to the directions which the end portion 22 extends, the claw member 32 extends outwardly in the longitudinal direction of the head at a curve inward and downward towards the handle. The claw member generally comprises two fingers 34 having a V-shaped gap therebetween to act as a nail puller similar to conventional hammer designs.

The body surrounding the impact face 30 is generally cylindrical in shape and narrows at a neck 36 forming one or more through bores 37 therein to act as a vibration arrester port before becoming enlarged at a main portion of the body 28 which locates a through opening 38 therein. The through opening snugly receives the end portion 22 of the handle at an inner end 40 thereof while snugly receiving a wedge member 42 at an opposite outer end 44 of the opening. The end portion 22 is wedge shaped so as to snugly secure the tool head thereon in a wedging action.

The wedge member 42, the end portion of the handle and the opening 38 all have a matching square cross section with the depth of the opening 38 being approximately double the depth of each of the end portion and the wedge such that the end portion and the wedge are received end to end across the full depth of the opening. Any other shape of cross section including various polygonal shapes, or round and oval shapes may be used as desired.

The wedge member 42 increases in cross sectional dimension towards the outer end 44 of the opening within which it is received for retaining the hammer head on the handle when the wedge is secured to the end portion of the handle. The wedge member has a suitable thickness to project slightly beyond the outer end 44 of the opening when the hammer head is coupled to the handle so as to permit some slight compression of the wedge member within the body of the hammer head.

A recess 46 is formed in the outer end 44 about the opening so as to be slightly larger in dimension then the opening. A compression plate 48 is provided which fits within the recess to span the opening 44 and cover the wedge member 42 received therein.

The end portion of the handle includes a bore 50 formed therein which lies generally parallel to the direction which the end portion of the handle extends. The bore 50 extends from an open end at the end portion of the handle, at least one third a length of the handle, to a terminal end of the bore inside the handle. A mounting rod 52 is provided which has screw threads at an inner end for anchoring within the bore 50 in the handle at the terminal end of the bore to retain the rod in the handle. The bore 50 is slightly larger in diameter than the rod 52 to permit a compressible spring 54 to be received about the rod within the bore 50.

The rod 52 has a suitable length so as to project outward from the handle a distance which is similar or less than the thickness of the wedge member. The free end of the rod 52 projecting externally from the end portion of the handle is externally threaded for receiving a threaded nut 56 thereon. The wedge member and the compression plate 48 received thereon each include respective bores 58 and 59 in alignment with the rod 52 for receiving the rod therethrough.

The nut 56 comprises a sleeve which is internally threaded and of suitable dimension to be received within the respective bores in the plate and wedge member to be threaded overtop of the rod. A head of the nut is supported at the external end of the sleeve and includes a socket formed therein for tightening of the nut overtop of the external threading of the rod with which the nut mates.

A resilient rubber washer 60 is provided about the sleeve for abutting the confronting face of the nut 56 which clamps down onto the compression plate for clamping the plate and wedge member with the surrounding hammer head between the face of the nut and the shoulder of the handle with which the tool head abuts.

When the nut is secured on the end of the rod 52, the rod which is a rigid member, is under tension between the terminal end of the bore and the nut 56 which acts as a clamping member securing the head to the handle. The handle accordingly is under compression between the terminal end of the bore and the head for increasing the strength thereof by introducing a pre-stressed condition to the material forming the handle regardless of whether the handle is formed of wood, fibreglass, metal or other materials.

A reinforcing mesh hafting material 62 is wrapped about the transition portion of the handle and about the shoulder defined at the end portion to provide added reinforcement of the handle adjacent the tool head which is mounted thereon.

A fulcrum attachment 64 is provided which can be secured at the outer end of the opening on top of the hammer head, opposite the handle. The fulcrum attachment includes a domed outer surface which is convex in profile to extend outward from the body of the hammer head opposite the handle in a curved profile which is continuous with the curve of the claw member. A hole 68 in the outer surface receives the nut 56 to permit selective attachment with the threaded fastener of the tool head securement to the handle. As well, the hole 68 also facilitates provisions for pulling smaller nails.

Figure 7:
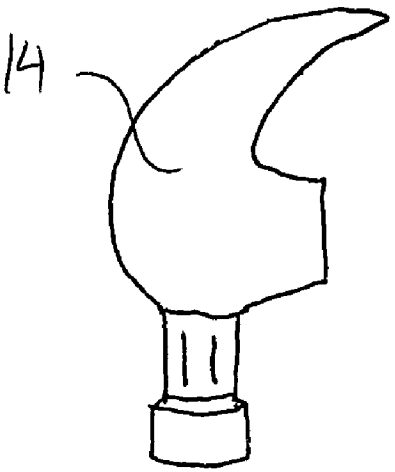

As illustrated in FIG. 7, in an alternate design of the hammer head, the fulcrum attachment may be formed integrally with the body of the hammer head.

Figure 8:
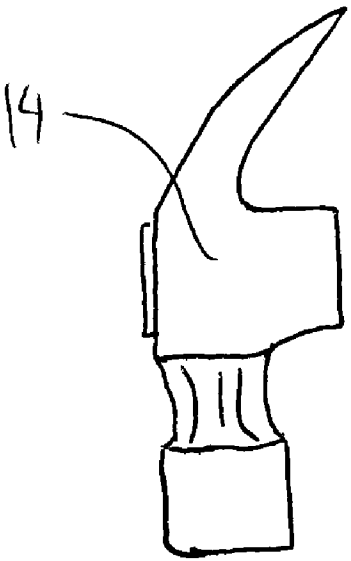
FIGS. 7 and 8 are side elevational views of varying tool heads for being supported on the handle of the present invention.

As illustrated in FIG. 8, in further embodiments the body of the hammer head may have varying dimensions to vary the size of the impact face or to produce a heavier hammer having greater impact. In the embodiment of FIG. 8, the portion of the body surrounding the impact face forms a cylindrical portion larger in diameter than in the previous embodiments and which extends a greater depth before the reduced dimension of the neck leading to the main portion of the body.

Figure 9:
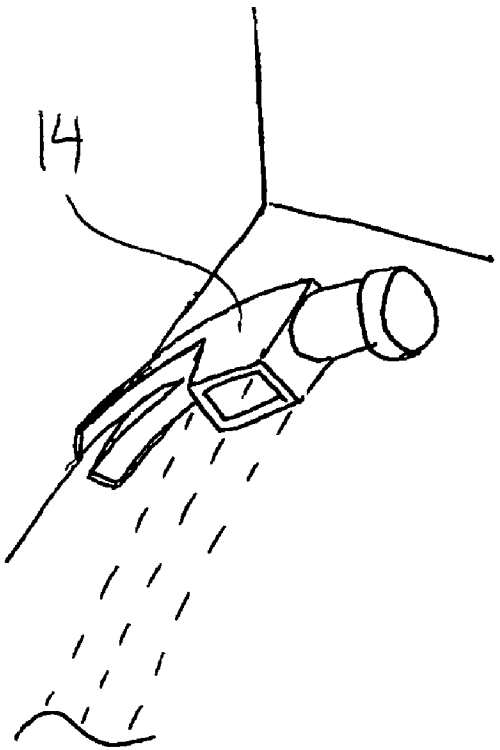
FIG. 9 is a rear elevational view of a further embodiment of the tool head.

As illustrated in FIG. 9 an optional hammer head to be included with the other head designs disclosed herein as a kit with the handle, may include a claw member in which the pair of fingers of the claw are inclined in a generally V-shaped configuration in cross section for a greater accessibility in corners between a floor and wall for example as illustrated. Details of the angled claw member are disclosed in Canadian patent 2,208,951, the disclosure of which is incorporated herein by reference.

As described above, an ergonomic tool handle is provided which can readily be applied to various hand tools. In the illustrated embodiment a plurality of different hammer heads may be provided which are selectively mounted using threaded fasteners onto the handle to permit replacement of the head with different styles of hammer heads having different properties as required for different applications. In some instances the wedge member alone may be desired to be replaced to provide a wedge member of varying material density from remaining wedge members in a kit whereby the impact force of the hammer may be varied due to the varying weight at the head.

The hafting material disclosed above comprises wire mesh in the illustrated embodiment, however the material may consist of single wire strands which are wrapped about the handle in single or multiple layers. Also the material could consist of a solid material, for example tin or composites and the like. The hafting provides additional support particularly when applying lateral forces for pulling nails and the like and is useful to prevent chipping of the handle in areas of high risk of failure. The hafting further provides stability and prevents splintering when compression forces are applied as the hammer head is attached to the handle with the compression plate and compression nut in order to maintain a solid hammer head and handle interface. Stability and splintering is also provided when compression forces are applied when the hammer is used as a lever during extracting or prying of nails and other objects.

Despite the ancient and modern art of hammer design which attempted to provide features and modern conveniences that would increase safe work efficiency, none provide the features of the tool handle and hammer system described herein.

Generally, a tool or implement is comprised of two main parts, the handle and the attachment that does the work. The concept and principle of the tool handle design can be applied to a multitude of other implements in addition to the hammer system illustrated herein, for example, in sporting equipment such as ice climbing picks, other construction or garden tools, and the like.

The hammer described herein is made up of two main parts, namely the hammer handle and the hammer head. This tool features unique detachable hammer heads along with a tool handle that allows the user to manipulate the tool efficiently and safely.

The ergonomic handle design controls deviated wrist postures and enhances visual control of the tool surface interface. The design is intended to maximize operator efficiency and at the same time reduce overuse injuries and awkward postures in the wrist, arm and shoulder.

The handle features three major design qualities which adjust the tool to adapt to the anatomical line of the wrist and forearm, improve the sight line to the impact surface, and increase friction to achieve a firm grip.

The medial curve causes a lateral rotation impact torque but this is compensated for at the neck of the hammer head by a countering compound angle including a lateral and a vertical component. The effect of this compound angle provides significant improved visual alignment and sight line to the target plus improved alignment of the handle with the forearm.

The ergonomic tool handle grip surface is designed to accommodate a larger than usual friction surface for the power grip, and bulges and associated anchor points within the handle to provide palm support. The power grip involves more of the medial or under side of the hand and provides greater palm surface and a firmer grip.

The precision grip involves more of the lateral aspects of the palm including the index finger and the thumb and results in lower grip strength, but more control. The tool handle disclosed herein facilitates both power and precision grip. The purpose of the handle is to facilitate the transmission of force from the user to the target.

The handle design will avoid unsuitable postures and unnecessary muscle exertion and allow the user to hold the handle securely with appropriate wrist, arm and shoulder posture. The bulges and anchor points along the handle allow many hand positions without causing compression of soft tissues, abrasions, blisters or formation of calluses. The bulges also provide much needed friction.

This design calibrates the relation between handle size and hand size which is important. If the handle is too small, not much force can be exerted, and large local tissue pressure might be generated. If the handle is too large for the hand, hand muscle must work at disadvantaged lever arms. As a result, fatigue factors and less grip strength come into play.

While various embodiments of the present invention have been described in the foregoing, it is to be understood that other embodiments are possible within the scope of the invention. The invention is to be considered limited solely by the scope of the appended Claims.

The invention claimed is:

1. A hand tool comprising:

an impact tool head for performing work by impacting a surface; and a handle including a main portion extending in a longitudinal direction between a gripping portion and a tool head supporting portion opposite the gripping portion which supports the impact tool head thereon, the longitudinal direction lying generally in a vertical plane and a horizontal plane in use;

the gripping portion being offset at a compound angle inclination in relation to the longitudinal direction of the main portion, the compound angle inclination including a lateral angle deviation from the vertical plane and a vertical angle deviation from the horizontal plane of the longitudinal direction;

the tool head supporting portion being offset at an inclination in relation to the longitudinal direction of the main portion including a lateral angle deviation from the vertical plane of the longitudinal direction; and the lateral angle deviation of the gripping portion and the lateral angle deviation of the tool head supporting portion being offset in a same direction relative to the vertical plane.

2. A tool according to claim 1 wherein the tool head supporting portion is offset from the main portion of the handle at a compound angle inclination in relation to the longitudinal direction of the main portion including the lateral angle deviation from the vertical plane of the longitudinal direction and a vertical angle deviation from the horizontal plane of the longitudinal direction.

3. A tool according to claim 2 wherein the vertical angle deviation of the gripping portion and the vertical angle deviation of the tool head supporting portion are offset in opposite directions relative to the horizontal plane.

4. A hammer kit comprising:

an elongate handle having a main portion and an end portion of reduced dimension;

a head having a body and an opening formed in the body for snugly receiving the end portion of the handle therein;

a threaded fastener mechanism for securing the end portion of the handle within the opening in the head whereby the head remains selectively separable from the handle; and a plurality of weighted members, each being selectively mountable in the opening in the body;

the weighted members being interchangeable with one another and having differing weight from one another.

5. The hammer kit according to claim 4 wherein the opening extends through the body of the head and wherein each weighted member comprises a wedge for being snugly received in one end of the opening, the narrow portion of the handle being received in an opposing end of the opening.

6. The hammer kit according to claim 5 wherein each wedge includes a through bore receiving the fastening mechanism therethrough.

7. The hammer kit according to claim 5 wherein there is provided a plate member spanning the end of the opening receiving each wedge therethrough, the fastening mechanism securing the plate member to the handle for clamping the head and wedge member therebetween.

8. The hammer kit according to claim 4 wherein the fastening mechanism comprises a threaded rod supported on the handle and a threaded nut securing the head between the nut and the handle.

9. The hammer kit according to claim 4 wherein the fastening mechanism includes a first threaded member secured to the handle and a second threaded member for mating with the first threaded member, the fastening mechanism including a resilient washer clamped between confronting faces of the first and second threaded members.

10. The hammer kit according to claim 4 wherein the handle includes reinforcing hafting material surrounding the main portion adjacent the end portion supporting the head thereon.

11. The hammer kit according to claim 4 wherein the body of the head extends in a longitudinal direction of the head between an impact face which is perpendicular to the longitudinal direction and a claw member which curves in the longitudinal direction towards the handle, the handle being supported transversely to the longitudinal direction of the head and wherein there is provided a domed fulcrum member selectively mounted on the body of the head opposite the handle.

12. The hammer kit according to claim 4 wherein the body of the head extends in a longitudinal direction of the head between an impact face which is perpendicular to the longitudinal direction and a claw member which curves in the longitudinal direction towards the handle, the handle being supported transversely to the longitudinal direction of the head and wherein the body of the head includes a domed fulcrum member integrally formed on the body of the head opposite the handle and which is continuous in profile with the claw member.

13. The hammer kit according to claim 4 comprising a plurality of heads, each having an opening formed therein of similar configuration for receiving the end portion of the handle therein, each head varying in dimensions from remaining heads of the kit.

14. The hammer kit according to claim 13 wherein at least one head includes an impact area differing in dimensions from remaining heads of the kit.

15. The hammer kit according to claim 13 wherein at least one head includes a weight which is greater than a weight of at least some of the remaining heads of the kit.

16. The hammer kit according to claim 4 wherein the main portion of the handle extends in a longitudinal direction of the handle between a gripping portion of the handle and the end portion supporting the head thereon opposite the gripping portion, both the gripping portion and the end portion being offset at an inclination in relation to the longitudinal direction of the main portion.

17. The hammer kit according to claim 16 wherein the longitudinal direction of the main portion lies generally in a vertical plane and a horizontal plane in use;

the gripping portion being offset at a compound angle inclination in relation to the longitudinal direction of the main portion, the compound angle inclination including a lateral angle deviation from the vertical plane and a vertical angle deviation from the horizontal plane of the longitudinal direction;

the tool head supporting portion being offset at a compound angle inclination in relation to the longitudinal direction of the main portion including a lateral angle deviation from the vertical plane of the longitudinal direction and a vertical angle deviation from the horizontal plane of the longitudinal direction;

the vertical angle deviation of the gripping portion and the vertical angle deviation of the tool head supporting portion being offset in opposite directions relative to the horizontal plane.

18. The hammer kit according to claim 16 wherein the longitudinal direction of the main portion lies generally in a vertical plane and a horizontal plane in use;

the gripping portion being offset at a compound angle inclination in relation to the longitudinal direction of the main portion, the compound angle inclination including a lateral angle deviation from the vertical plane and a vertical angle deviation from the horizontal plane of the longitudinal direction;

the end portion being offset at an inclination in relation to the longitudinal direction of the main portion including a lateral angle deviation from the vertical plane of the longitudinal direction;

the lateral angle deviation of the gripping portion and the lateral angle deviation of the end portion being offset in a same direction relative to the vertical plane.

19. A hammer comprising:

an elongate handle having a main portion and an end portion of reduced dimension;

a head having a body and an opening formed in the body for snugly receiving the end portion of the handle therein;

a threaded fastener mechanism for securing the end portion of the handle within the opening in the head whereby the head remains selectively separable from the handle, the mechanism comprising a threaded rod supported on the handle and a threaded nut securing the head between the nut and the handle, the threaded rod being received in a bore formed in the handle; and a compressible member surrounding the rod within the bore.

20. A hammer comprising:

an elongate handle having a main portion extending in a longitudinal direction between a gripping portion and a tool head supporting portion opposite the gripping portion, both the gripping portion and the tool head supporting portion being offset at an inclination in relation to the longitudinal direction of the main portion, and an end portion of reduced dimension on the tool head supporting portion;

the handle including an elongate bore extending approximately one third a length of the handle from an opening at the end portion to a terminal end within the handle;

a head having a body and an opening formed in the body for snugly receiving the end portion of the handle therein; and a tension member received through the bore in the handle and secured under tension between the terminal end of the bore and the head;

wherein the handle is maintained under compression only between the terminal end of the bore and the end portion by the tension member.

21. The hammer according to claim 20 wherein the tension member comprises a rigid rod.

22. The hammer according to claim 20 wherein the tension member is threadably secured to the terminal end of the bore.

23. The hammer according to claim 20 wherein the head is secured to the handle by a clamping member threadably secured to the tension member.

* * * * *